US011601774B2

(12) United States Patent
Noh

(10) Patent No.: US 11,601,774 B2
(45) Date of Patent: Mar. 7, 2023

(54) SYSTEM AND METHOD FOR REAL TIME LOUDSPEAKER EQUALIZATION

(71) Applicant: DTS, Inc., Calabasas, CA (US)

(72) Inventor: Daekyoung Noh, Huntington Beach, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 17/269,159

(22) PCT Filed: Aug. 14, 2019

(86) PCT No.: PCT/US2019/046505
§ 371 (c)(1),
(2) Date: Feb. 17, 2021

(87) PCT Pub. No.: WO2020/037044
PCT Pub. Date: Feb. 20, 2020

(65) Prior Publication Data

US 2021/0314721 A1 Oct. 7, 2021

Related U.S. Application Data

(60) Provisional application No. 62/719,520, filed on Aug. 17, 2018.

(51) Int. Cl.
*H04S 7/00* (2006.01)
*H04R 3/04* (2006.01)

(52) U.S. Cl.
CPC ..... *H04S 7/301* (2013.01); *H04R 3/04* (2013.01)

(58) Field of Classification Search
CPC ..... H04S 7/301; H04R 3/04; H03G 5/165
(Continued)

(56) References Cited

U.S. PATENT DOCUMENTS 4,458,362 A 7/1984 Berkovitz et al.
6,721,428 B1 4/2004 Allred et al.
(Continued)

FOREIGN PATENT DOCUMENTS

CN 101361405 A 2/2009
WO WO-2020037044 A1 2/2020

OTHER PUBLICATIONS

"International Application Serial No. PCT/US2019/046505, International Search Report dated Oct. 23, 2019", 5 pgs.
(Continued)

*Primary Examiner* — Xu Mei
(74) *Attorney, Agent, or Firm* — Schwegman Lundberg & Woessner, P.A.

(57) ABSTRACT

A loudspeaker system can include a first loudspeaker driver provided in a substantially fixed spatial relationship relative to a microphone. The loudspeaker driver can be tuned, for example automatically and without user input. In an example, the tuning can include receiving transfer function reference information about the first loudspeaker driver and the microphone, and receiving information about a desired acoustic response for the loudspeaker system. The tuning can include determining a simulated response for the loudspeaker system using a first input signal and the transfer function reference information, and can include providing the first input signal to the first loudspeaker driver. In response to the first input signal, an actual response for the loudspeaker driver can be received using the microphone. A compensation filter can be determined for the loudspeaker system based on the determined simulated response and the received actual response for the loudspeaker system.

20 Claims, 13 Drawing Sheets

(58) Field of Classification Search
USPC ..... 381/303, 103
See application file for complete search history.

(56) References Cited

U.S. PATENT DOCUMENTS

| | | | | |
|---|---|---|---|---|
| 6,876,750 | B2 | 4/2005 | Allred et al. | |
| 8,340,317 | B2 | 12/2012 | Pfaffinger et al. | |
| 9,992,595 | B1 | 6/2018 | Choisel et al. | |
| 10,523,172 | B2 * | 12/2019 | Shaya | G06F 3/167 |
| 10,734,965 | B1 * | 8/2020 | McPherson | G06F 3/165 |
| 2005/0031129 | A1 * | 2/2005 | Devantier | H04S 7/301 381/18 |
| 2006/0062398 | A1 | 3/2006 | Mckee et al. | |
| 2007/0025557 | A1 | 2/2007 | Nackvi et al. | |
| 2007/0025559 | A1 | 2/2007 | Mihelich et al. | |
| 2007/0030979 | A1 | 2/2007 | Nackvi et al. | |
| 2007/0032895 | A1 | 2/2007 | Nackvi et al. | |
| 2008/0069378 | A1 | 3/2008 | Rabinowitz et al. | |
| 2009/0003613 | A1 | 1/2009 | Christensen | |
| 2010/0290643 | A1 | 11/2010 | Mihelich et al. | |
| 2010/0305725 | A1 | 12/2010 | Brannmark et al. | |
| 2014/0112497 | A1 | 4/2014 | Bongiovi et al. | |
| 2014/0153744 | A1 | 6/2014 | Brannmark et al. | |
| 2015/0263692 | A1 * | 9/2015 | Bush | H03G 3/32 381/103 |
| 2016/0020744 | A1 | 1/2016 | Kok et al. | |
| 2016/0366517 | A1 * | 12/2016 | Chandran | H04S 7/307 |
| 2017/0033755 | A1 | 2/2017 | Bongiovi et al. | |
| 2017/0201845 | A1 | 7/2017 | Bonnick et al. | |
| 2017/0272859 | A1 | 9/2017 | Hansen et al. | |
| 2017/0288625 | A1 | 10/2017 | Kim et al. | |
| 2017/0295445 | A1 | 10/2017 | Christoph et al. | |

OTHER PUBLICATIONS

"International Application Serial No. PCT/US2019/046505, Written Opinion dated Oct. 23, 2019", 12 pgs.
"Chinese Application Serial No. 201980064260.6, Office Action dated May 30, 2022", English translation, 25 pgs.
"International Application Serial No. PCT/US2019/046505, International Preliminary Report on Patentability dated Mar. 4, 2021", 14 pgs.

* cited by examiner

SYSTEM AND METHOD FOR REAL TIME LOUDSPEAKER EQUALIZATION

CROSS-REFERENCE TO RELATED APPLICATIONS

This application is a U.S. National Stage Filing under 35 U.S.C. 371 from International Application No. PCT/US2019/046505, filed on Aug. 14, 2019, and published as WO 2020/037044 on Feb. 20, 2020, which claims the benefit of priority to U.S. Provisional Patent Application No. 62/719,520, filed on Aug. 17, 2018, all of which are incorporated by reference herein in their entireties.

BACKGROUND

Acoustic system calibration and loudspeaker equalization can be used to adjust an actual or perceived acoustic response of an audio reproduction system. In an example, loudspeaker equalization can include manually or automatically adjusting a frequency response of an audio signal to be provided to a loudspeaker to thereby obtain a desired acoustic response when the loudspeaker is driven by the audio signal. Equalization filters can be determined in a design phase, such as before or during production of a loudspeaker device, such as to provide a pre-tuned system. However, such a pre-tuned system can be inadequate in some circumstances or environments, for example, because different environments or listening areas can have physically different characteristics. The various different physical characteristic of an environment can cause positive or negative interference of sound waves that can lead to emphasis or de-emphasis of various frequencies or acoustic information.

To resolve such errors caused by environment characteristics or other factors, room equalization techniques can be used. Room equalization can include correcting a frequency response or phase of an audio reproduction system to obtain a desired response in a given environment. Conventional room equalization can include or use measured loudspeaker frequency response information or phase response information, such as can be acquired in an environment using one or more microphones. The one or more microphones are typically provided externally to the loudspeaker. Such tuning or equalization procedures can be inconvenient for users and can lead to inadequate or incomplete tuning, for example, when a loudspeaker is relocated in the same environment or when a loudspeaker is relocated to a different environment.

BRIEF SUMMARY

The present inventor has recognized that a problem to be solved includes tuning an acoustic system. The problem can include automating a tuning procedure or making the procedure simple for an end-user or consumer to perform. In an example, the problem can include providing an acoustic system with sufficient and adequate hardware, such as a loudspeaker, microphone, and/or signal processing circuitry, that can be used to perform acoustic tuning.

In an example, the present subject matter can provide a solution to these and other problems. The solution can include systems or methods for automatically adjusting a loudspeaker response in a particular environment, for example substantially in real-time and without user input. In an example, the solution can include or use a loudspeaker and a microphone, such as can be provided together in an integrated or combined audio reproduction unit.

In an example, the solution can include measuring a response of the loudspeaker using the microphone. A combined transfer function for the loudspeaker, the tuned equalization, and the microphone can be created and stored in a memory associated with the unit, such as in a design stage or at a point of manufacture. At run-time or during a use phase, the audio reproduction unit can be configured to process an audio signal played by the unit using the stored transfer function. The processed signal can be compared with an audio signal captured by the microphone. A difference in signal information can be calculated to identify a frequency response as changed or influenced by the environment, and a compensation filter can be determined. The compensation filter can be applied to subsequent audio signals and used to correct or tune a response of the unit. In an example, the subsequent audio signals can include a later portion of the same program or material used to generate the signal difference information.

This Summary is intended to provide an overview of the subject matter of the present patent application. It is not intended to provide an exclusive or exhaustive explanation of the invention. The detailed description is included to provide further information about the present patent application.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
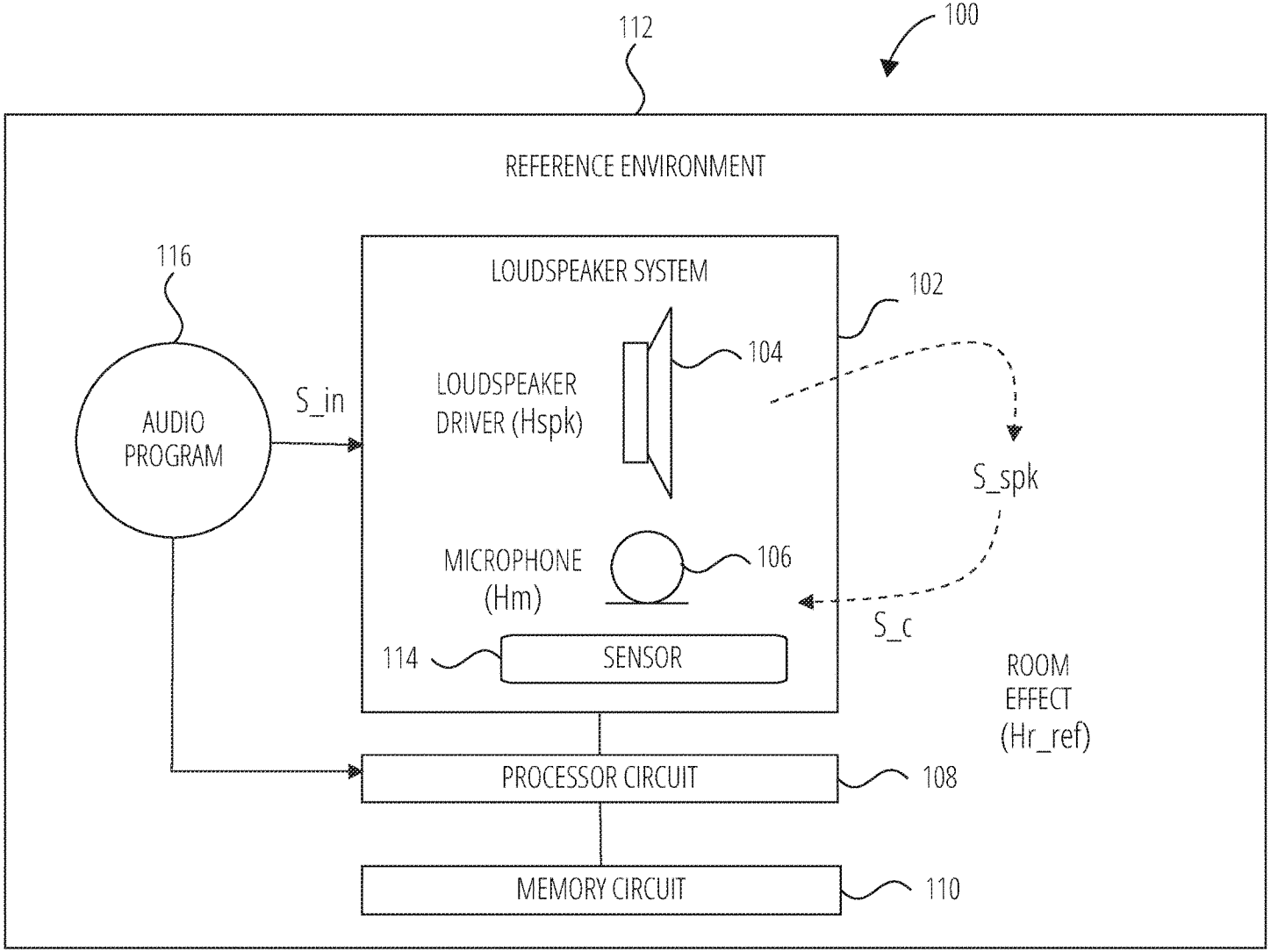
FIG. 1 illustrates generally an example of a reference environment and a loudspeaker system.

In the following description that includes examples of systems, methods, apparatuses, and devices for performing audio signal processing, such as for providing acoustic system tuning, reference is made to the accompanying drawings, which form a part of the detailed description. The drawings show, by way of illustration, embodiments in which the inventions disclosed herein can be practiced. These embodiments are generally referred to herein as "examples." Such examples can include elements in addition to those shown or described. However, the present inventor also contemplates examples in which only those elements shown or described are provided. The present inventor contemplates examples using any combination or permutation of those elements shown or described (or one or more aspects thereof), either with respect to a particular example (or one or more aspects thereof), or with respect to other examples (or one or more aspects thereof) shown or described herein.

As used herein, the phrase "audio signal" is a signal that represents a physical sound. Audio processing systems and methods described herein can include hardware circuitry and/or software configured to use or process audio signals, such as using various filters. In some examples, the systems and methods can use signals from, or signals corresponding to, multiple audio channels. In an example, an audio signal can include a digital signal that includes information corresponding to multiple audio channels and can include other information or metadata. In an example, an audio signal can include one or more components of an audio program. An audio program can include, for example, a song, a soundtrack, or other continuous or discontinuous stream of audio or acoustic information.

In an example, conventional tuning for a loudspeaker in an environment or listening room can be a multiple-step process that relies upon various user inputs. For example, a conventional tuning process can include capturing a loudspeaker response using a reference microphone that is positioned by a user in an environment with a loudspeaker to be tuned, then creating equalization filters based on a response as received by the microphone, and then implementing the filters. In an example, a tuning process can be simplified or facilitated using the systems and methods discussed herein.

In an example, a loudspeaker tuning process can include or use a loudspeaker system, such as can include a loudspeaker driver and a microphone. The loudspeaker driver and microphone can be provided in a substantially fixed or otherwise known physical or spatial relationship. The present systems and methods can capture response information about the loudspeaker driver using the microphone, and can capture equalized response information from the loudspeaker driver using the same microphone, such as in a design phase or using a reference tuning environment. The response information can be converted to transfer functions representative of the loudspeaker driver or the microphone or the loudspeaker system. These transfer functions can be used to calculate a response or effect of a room or environment on acoustic information therein. In an example, information about the transfer functions can be stored, for example in a memory associated with the loudspeaker system.

In a playback environment or during a playback phase or use phase, an audio signal played by a loudspeaker system can be captured using a microphone. The audio signal can include various audio program material. The audio signal can be a designated test signal such as a sweep signal or noise signal, or can be another signal. That is, in an example, the audio signal played by the loudspeaker can be an arbitrary signal. In an example, the audio signal can be processed using the transfer functions to provide a simulated output signal with a desired response. The simulated output signal can, for example, be what a user would perceive or experience if the loudspeaker system is used in the reference tuning environment. The simulated output signal can be compared with an actual output signal, as received using the microphone to identify frequency response changes that can be attributed to an environment. In response, compensation filters can be generated and can be applied to subsequent input signals, such as substantially in real-time. In an example, the present systems and methods can be dynamic and adaptive such that output signals from the loudspeaker system can be substantially continuously monitored and compensation filters can be adjusted in response to environment changes or other changes. In an example, the compensation filter coefficients can be updated in response to a user input or other sensor input.

FIG. 1 illustrates generally an example 100 that includes a reference environment 112 and a loudspeaker system 102. The loudspeaker system 102 can include or can be coupled to a processor circuit 108, such as can include a digital signal processor circuit or other audio signal processor circuit. The processor circuit 108 can be configured to receive instructions or other information from a memory circuit 110.

In an example, the loudspeaker system 102 can be provided in the reference environment 112. The loudspeaker system 102 can include a first loudspeaker driver 104, such as can be mounted in an enclosure. The first loudspeaker driver 104 can have or can be characterized by a loudspeaker transfer function Hspk. The term "transfer function," as used herein, generally refers to a relationship between an input and an output. In the context of a loudspeaker driver, a transfer function can refer to a response of the loudspeaker driver to various different input signals or signal frequencies. For example, the loudspeaker transfer function Hspk can include information about a time-frequency response of the first loudspeaker driver 104 to an impulse stimulus, to a white noise stimulus, or to a different input signal. In an example, the first loudspeaker driver 104 can receive an input signal S_in, such as can comprise a portion of an audio program 116. In an example, the input signal S_in is received by the first loudspeaker driver 104 from an amplifier circuit, from a digital signal processing circuit such as the processor circuit 108, or from another source.

The loudspeaker system 102 can include a microphone 106. The microphone 106 can be provided in a known or substantially fixed spatial relationship relative to the first loudspeaker driver 104. In an example, the microphone 106 and the first loudspeaker driver 104 can be mounted in a common enclosure such that positions of the microphone 106 and the first loudspeaker driver 104 do not change over time. The microphone 106 can be provided or arranged such that it receives acoustic information from the reference environment 112. That is, the microphone 106 can be coupled to an enclosure of the first loudspeaker driver 104 such that it receives at least some acoustic information from the reference environment 112 in response to acoustic signals provided by the first loudspeaker driver 104.

The microphone 106 can have or can be characterized by a microphone transfer function Jim. In an example, the transfer function Hm of the microphone 106 can include information about a time-frequency response of the microphone 106 to a particular input stimulus. In an example, the microphone 106 comprises a dynamic moving coil microphone, a condenser microphone, a piezoelectric microphone, a MEMS microphone, or other transducer configured to receive acoustic information and, in response, provide a corresponding electrical signal.

In an example, the loudspeaker system 102 can include a sensor 114. The sensor 114 can be configured to receive information, such as automatically or based on a user input, about a location or position of the loudspeaker system 102 or about a change in an environment. In an example, the sensor 114 is configured to detect a change in a location or position of the loudspeaker system 102. The sensor 114 can include, among other things, a position or location sensor such as a GPS receiver, an accelerometer, a gyroscope, or other sensor configured to sense or provide information about a location or orientation of the loudspeaker system 102. In an example, the sensor 114 includes a hardware or software input that can be accessed by a user or a controller device.

In an example, the processor circuit 108 includes an audio processor configured to receive one or more audio signals or channels of audio information, process the received signals or information, and then deliver the processed signals to the loudspeaker system 102, such as via an amplifier circuit or other signals processing or signal shaping filters or circuitry. In an example, the processor circuit 108 includes or uses a virtualizer circuit to generate virtualized or 3D audio signals from one or more input signals. The processor circuit 108 can generate the virtualized audio signals using one or more HRTF filters, delay filters, frequency filters, or other audio filters.

The example of FIG. 1 illustrates generally that the loudspeaker system 102 can receive an audio input signal S_in. The first loudspeaker driver 104 can receive and reproduce the input signal S_in to yield an acoustic output signal S_spk in the reference environment 112. In an example, the acoustic output signal S_spk can be represented by the input signal S_in processed according to the transfer function Hspk of the first loudspeaker driver 104, that is, S_spk=S_in*Hspk.

In an example, transfer function or other acoustic behavior information about the loudspeaker system 102 can be determined in a design environment or the reference environment 112, such as using an anechoic chamber or other room used for acquiring reference acoustic information. For example, in the reference environment 112, the first loudspeaker driver 104 can receive the input signal S_in, and the microphone 106 can receive or capture an acoustic response signal S_c. In an example, a room effect transfer function Hr_ref for the reference environment 112 can be neglected, for example when the reference environment 112 has an accepted or known acoustic room effect or is substantially transparent, and the acoustic response signal S_c for the reference environment can be represented as a function of the input signal S_in, the transfer function Hspk of the first loudspeaker driver 104, and the transfer function Hm of the microphone 106, that is, S_c=*Hspk*Hm. The transfer functions Hspk and Hm can be known a priori or can be determined using the loudspeaker system 102 in the reference environment 112.

Figure 2:
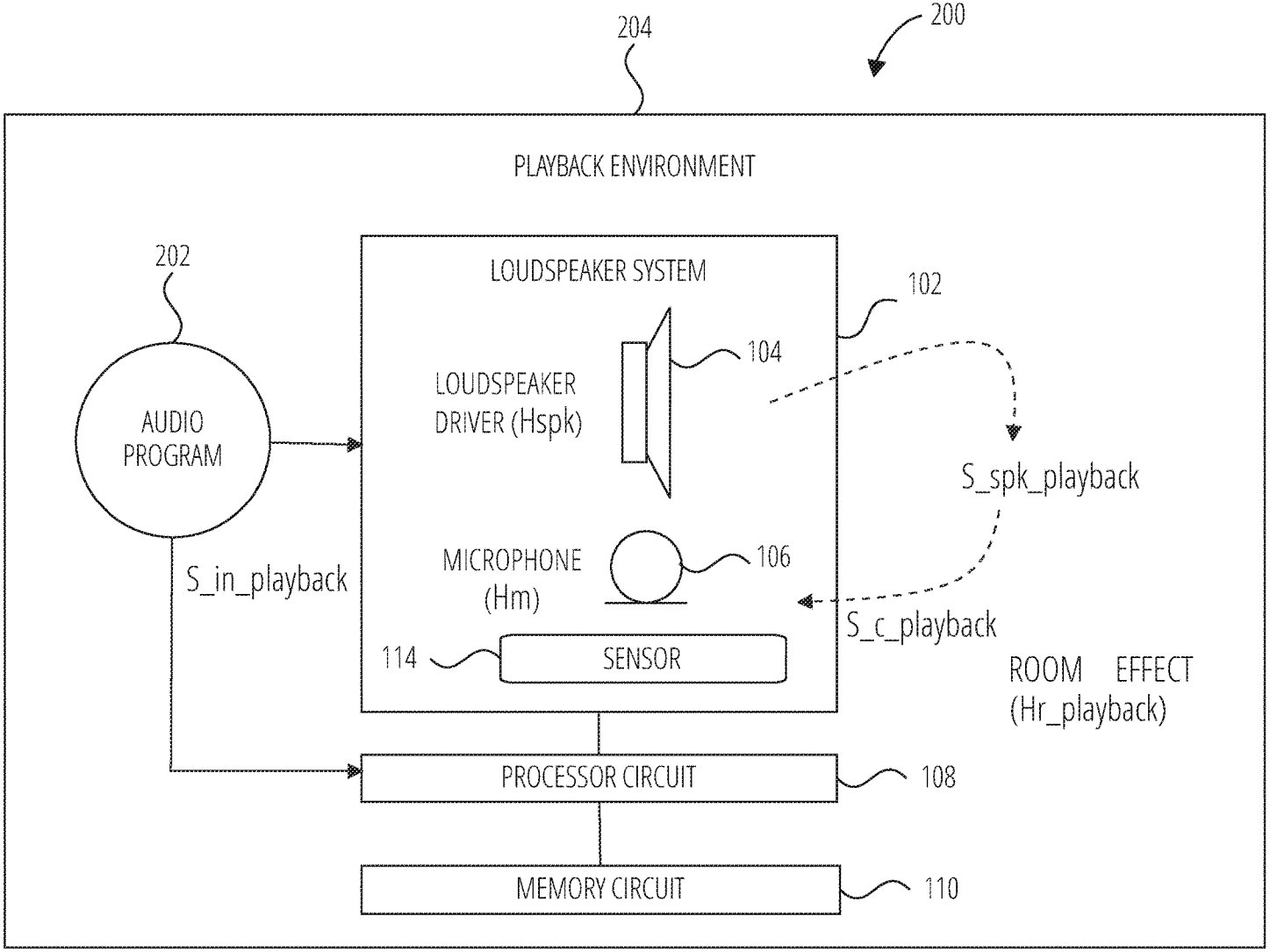
FIG. 2 illustrates generally an example of a playback environment and a loudspeaker system.

FIG. 2 illustrates generally an example 200 that includes a playback environment 204 and the loudspeaker system 102. The playback environment 204 can be a physically different environment than the reference environment 112 from the example of FIG. 1.

In an example, the playback environment 204 can include a physical space in which the loudspeaker system 102 can be used to deliver acoustic signals. In an example, the playback environment 204 can include an outdoor space or can include a room, such as can have walls, a floor, and a ceiling. In an example, the playback environment 204 can have various furniture or other physical objects therein. The different surfaces or objects in the playback environment 204 can reflect or absorb sound waves and can contribute to an acoustic response of the playback environment 204. The acoustic response of the playback environment 204 can include or refer to an emphasis or deemphasis of various acoustic information due to the effects of, for example, an orientation or position of an acoustic signal source such as a loudspeaker relative to objects and surfaces in the playback environment 204, and can be different than an acoustic response of the reference environment 112 of FIG. 1.

In an example, a simulated or calculated response of the loudspeaker system 102 can be used to determine a compensation filter to apply to other input signals to achieve a desired response of the loudspeaker system 102 in the playback environment 204. In an example, the simulated or calculated response of the loudspeaker system 102 can be based in part on the transfer function Hspk of the first loudspeaker driver 104 and the transfer function Hm of the microphone 106. The simulated or calculated response of the loudspeaker system 102 can be used together with captured information from the microphone 106 about an actual response of the loudspeaker system 102 in the playback environment 204 during use or during playback of an arbitrary input signal S_in_playback, and the arbitrary input signal S_in_playback can be, but is not required to be, different than the input signal Sin used to determine the transfer functions Hspk and Hm in the example of FIG. 1. In an example, the input signal S_in_playback comprises a portion of a user-selected audio program.

In an example, an acoustic output signal S_spk_playback can be provided, such as using the first loudspeaker driver 104, inside the playback environment 204. The playback environment 204 can have an associated environment transfer function or room effect transfer function Hr_playback. The room effect transfer function Hr_playback can be a function of, among other things, the geometry of the environment or objects in the playback environment 204 and can be specific to a particular location or orientation of a receiver such as a microphone inside of the playback environment 204. In the example of FIG. 2, the room effect transfer function Hr_playback is the transfer function of the playback environment 204 at the location of the microphone 106. Thus in an example, an acoustic signal S_c_playback captured at an input of the microphone 106 can be represented by the input signal S_in_playback processed according to the transfer function Hspk of the first loudspeaker driver 104 and the room effect transfer function Hr_playback, that is, $$S_c_playback = S_in_playback * Hspk * Hm * Hr_playback.$$

In an example, other signal processing or signal shaping filters can be applied at various locations in the signal chain. For example, an equalization filter can be applied to the input signal S_in_playback. Such other processing or equalization is generally omitted from FIG. 1 and FIG. 2 and this discussion for the sake of clarity.

Figure 3:
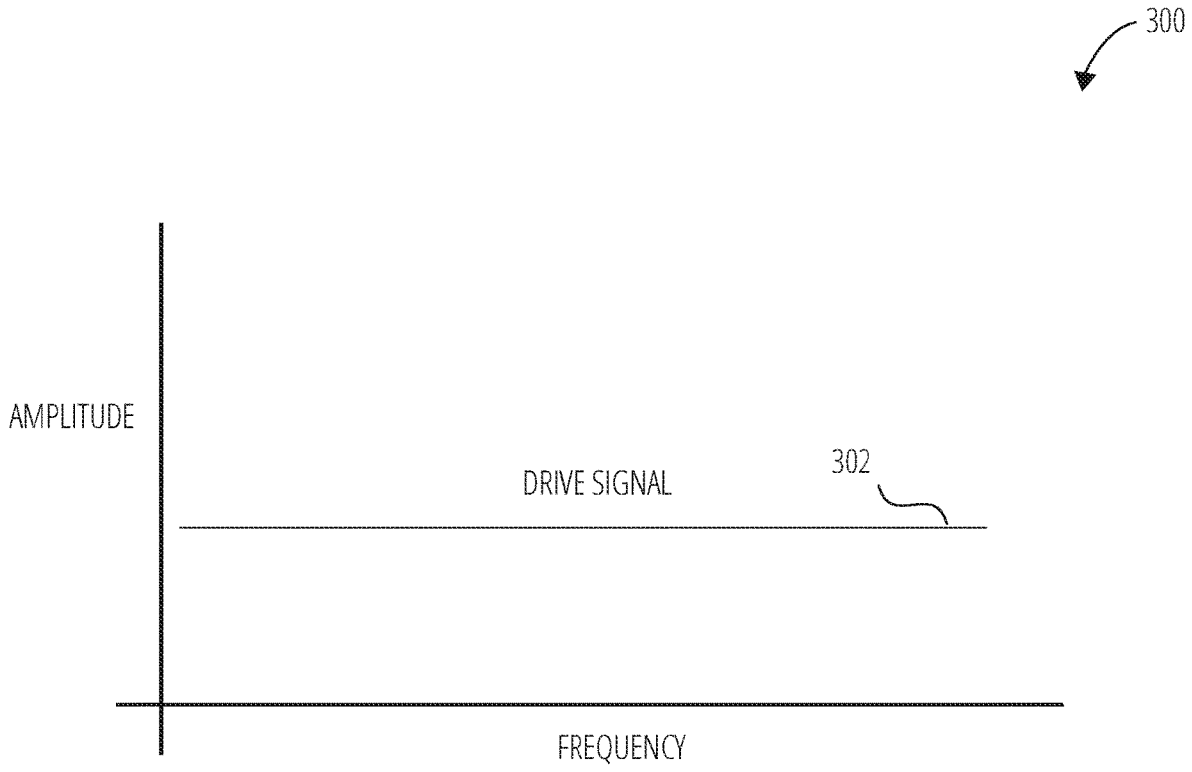
FIG. 3 illustrates generally an example of a drive signal chart n accordance with an embodiment.

FIG. 3 illustrates generally an example of a drive signal chart 300 in accordance with an embodiment. The drive signal chart 300 shows an amplitude-frequency chart with a theoretical drive signal 302. In the example of FIG. 3, the drive signal 302 can be an audio signal having substantially equal amplitude at all frequencies. Although no specific frequencies are enumerated on the x axis, the drive signal 302 can be understood to have content in at least a portion of an audible, acoustic spectrum, such as from about 20 Hz to 20 kHz. A smaller band of frequencies or other frequencies can also be used. In an example, the input signal S_in from the example of FIG. 1 or the input signal S_in_playback can include or correspond to the drive signal 302 of FIG. 3.

Figure 4:
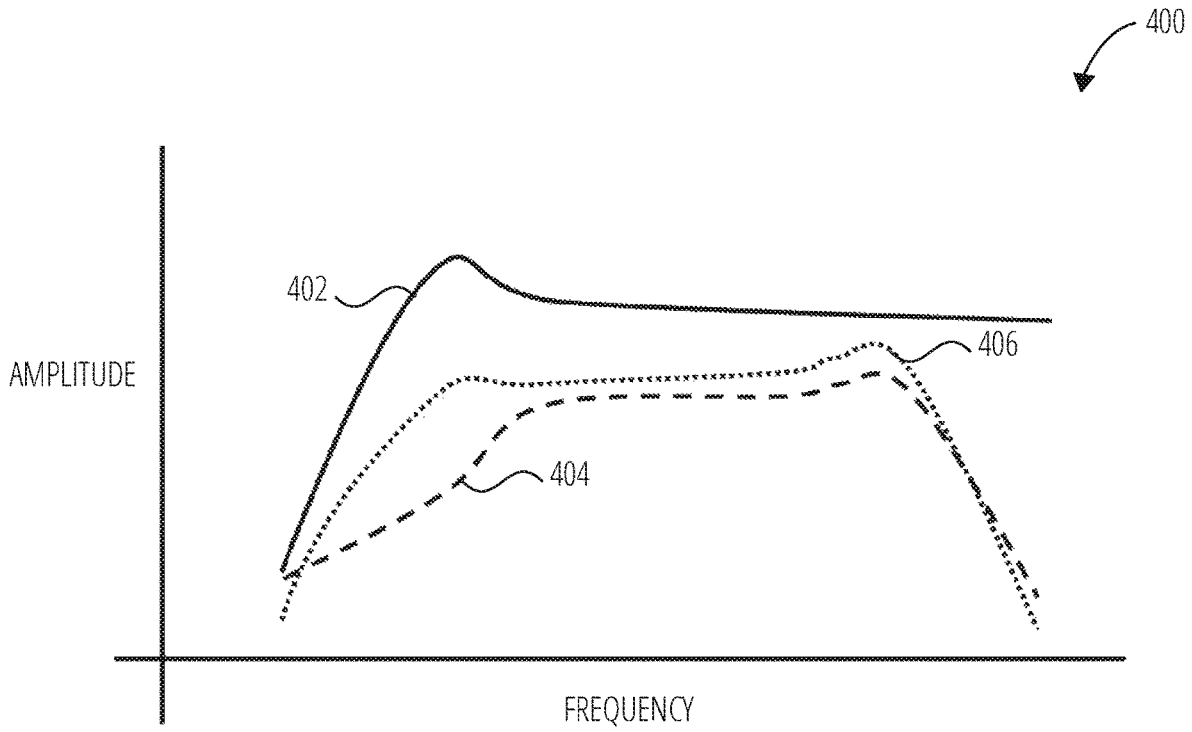
FIG. 4 illustrates generally an example of a reference chart in accordance with an embodiment.

FIG. 4 illustrates generally an example of a reference chart 400 in accordance with an embodiment. The reference chart 400 shows an amplitude-frequency chart and illustrates a loudspeaker transfer function 402, a microphone transfer function 404, and a captured reference signal 406.

In the example of FIG. 4, the loudspeaker transfer function 402 can include or correspond to the transfer function Hspk of the first loudspeaker driver 104 from the loudspeaker system 102. The microphone transfer function 404 can include or correspond to the transfer function Him of the microphone 106 from the loudspeaker system 102. The transfer function representations in FIG. 4 and elsewhere herein are simplified graphical representations for purposes of illustration.

In an example, the microphone transfer function 404 corresponds to the microphone transfer function Hm. The example of FIG. 4 shows the microphone transfer function 404 can have a substantially flat response over at least a portion of an acoustic spectrum but can have an attenuated response at relatively low and high frequencies. Other microphone transfer functions can similarly be used and will depend on, among other things, a type of microphone used, an orientation of the microphone used, or any filters or equalization applied at the microphone.

FIG. 4 includes a representation of a captured reference signal 406. In an example, the captured reference signal 406 can include or correspond to the acoustic response signal S_c, such as can be received using the microphone 106 when the loudspeaker system 102 is used in the reference environment 112. The captured reference signal 406 can be a function of at least (1) the loudspeaker transfer function 402, such as Hspk, (2) the microphone transfer function 404, such as Hm, and (3) the input signal, such as can include the drive signal 302. In an example, the captured reference signal 406 can be shaped or influenced by other functions or filters, however, such filters are omitted from the discussion herein. The captured reference signal 406 can be unique to the reference environment 112, meaning that the captured signal can be different in different environments even if the input signal is the same.

Figure 5:
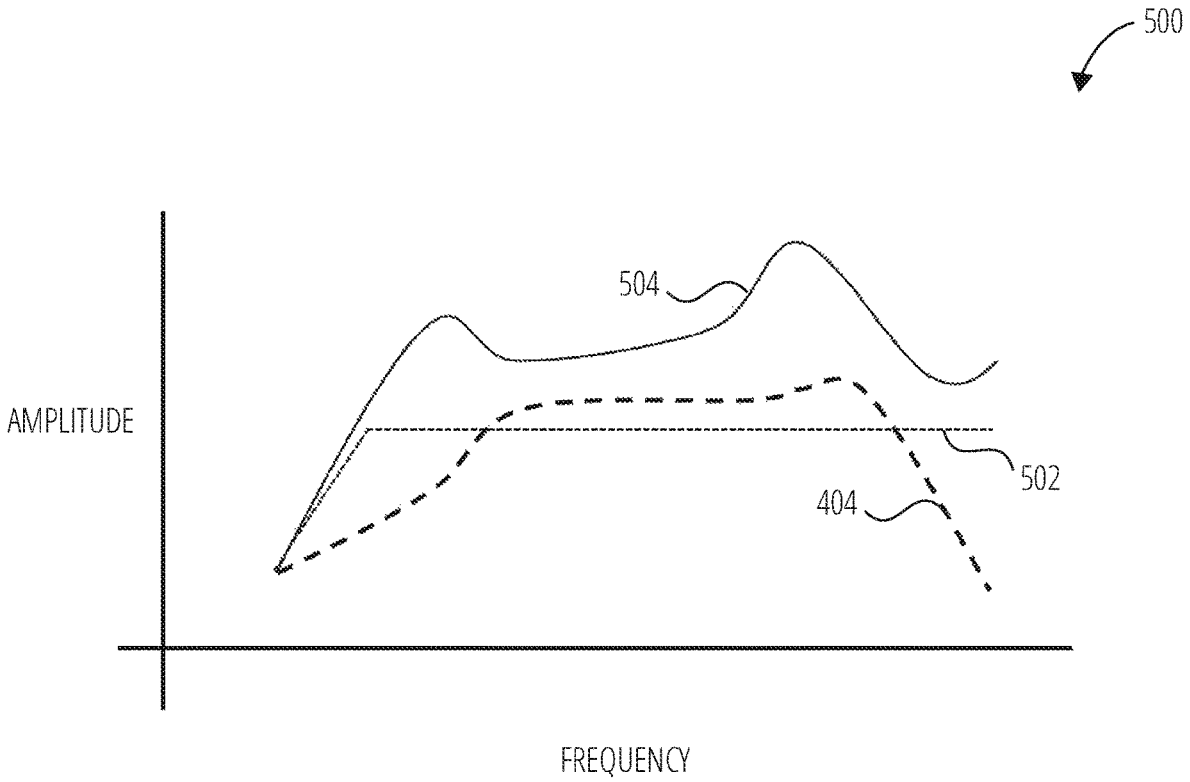
FIG. 5 illustrates generally an example of a first playback chart in accordance with an embodiment.

FIG. 5 illustrates generally an example of a first playback chart 500 in accordance with an embodiment. The first playback chart 500 shows an amplitude-frequency chart and illustrates a desired response 502 for the loudspeaker system 102, a playback environment transfer function 504, and the microphone transfer function 404.

In the example of FIG. 5, the desired response 502 represents a target frequency response or desired frequency response for the first loudspeaker driver 104 from the loudspeaker system 102. In other words, the desired response 502 can indicate that a response of the first loudspeaker driver 104 in the playback environment 204 is desired to be substantially flat, and that the first loudspeaker driver 104 responds essentially equally to frequency information throughout a portion of an acoustic spectrum, with an attenuated low frequency response. In an example, the desired response 502 can be set or defined by a user, can be a preset parameter that is established by a programmer or at a point of manufacture, or the desired response 502 can be otherwise specified, such as using a hardware or software interface.

In an example, the playback environment transfer function 504 can represent a transfer function associated with an environment or room or other listening space in which a loudspeaker is used. In the example of FIG. 5, the playback environment transfer function 504 indicates a transfer function associated with the playback environment 204. The playback environment transfer function 504 example of FIG. 5 shows the function can have various peaks and valleys such as can be a product of positive and negative interference of sound waves in an environment. In an example, the playback environment transfer function 504 corresponds to the room effect transfer function Hr_playback from the example of FIG. 2. The playback environment transfer function 504 can represent a transfer function based on a reference stimulus, such as an acoustic impulse signal or other reference signal.

Figure 6:
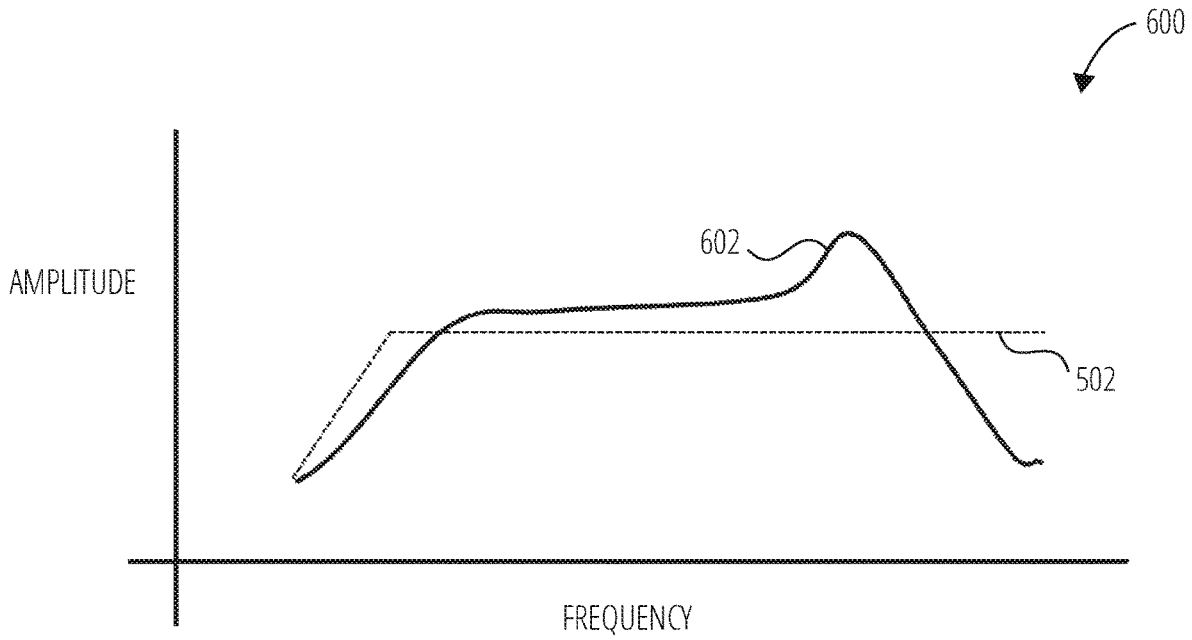
FIG. 6 illustrates generally an example of a second playback chart in accordance with an embodiment.

FIG. 6 illustrates generally an example of a second playback chart 600 in accordance with an embodiment. The second playback chart 600 shows an amplitude-frequency chart and illustrates the desired response 502 from the example of FIG. 5 and a captured playback signal 602. The captured playback signal 602 can represent an audio signal received, such as using the microphone 106, in the playback environment 204 and in response to the input signal S_in_playback. In other words, the captured playback signal 602 can represent a signal received by the microphone 106 and can include any room effects such as the roof effect transfer function Hr_playback for the playback environment 204. The captured playback signal 602 can therefore be a function of at least (1) the input signal S_in_playback (such as the drive signal 302), (2) the loudspeaker transfer function Hspk for the first loudspeaker driver 104, (3) the room effect transfer function Hr_playback for the playback environment 204, and (4) the microphone transfer function Hm.

In an example, the captured playback signal 602 can include the acoustic signal S_c_playback, such as described above in the discussion of FIG. 2, that can be received or captured at an input of the microphone 106. The acoustic signal S_c_playback can be represented as a function of the input signal S_in_playback processed according to the transfer function Hspk of the first loudspeaker driver 104, the transfer function Hm of the microphone 106, and the room effect transfer function Hr_playback, that is, $$S_c_playback = S_in_playback * Hspk * Hm * Hr_playback.$$

In an example, the transfer function Hspk of the first loudspeaker driver 104 can be known and the transfer function Hm of the microphone 106 can be known, such as from a design phase (see, e.g., the examples of FIG. 1 and FIG. 4). The acoustic signal S_c_playback and the input signal S_in_playback can be also known. Therefore the room effect transfer function Hr_playback can be calculated. For example, $$Hr_playback = S_c_playback / (S_in_playback * Hspk * Hm).$$

In an example, to achieve the desired response 502 using the loudspeaker system 102, input signals to the first loudspeaker driver 104 can be processed according to a compensation filter that is designed or selected for the playback environment 204. That is, the compensation filter can be selected to process input signals for the first loudspeaker driver 104 such that, in response to the input signals, the response of the first loudspeaker driver 104 as experienced by a listener in the playback environment 204 substantially corresponds to the desired response 502. In an example, determining the compensation filter can include or use information from the captured playback signal 602 and from a calculated response to the same input signal used to acquire the captured playback signal 602.

Figure 7:
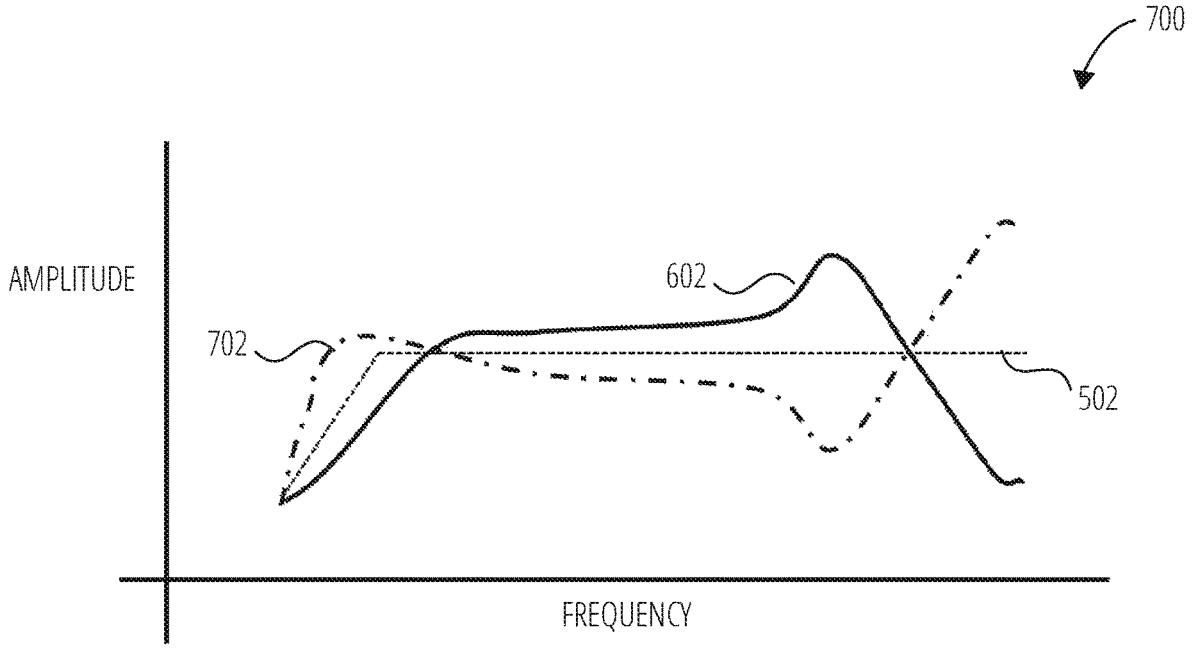
FIG. 7 illustrates generally an example of a compensation filter chart in accordance with an embodiment.

FIG. 7 illustrates generally an example of a compensation filter chart 700 in accordance with an embodiment. The compensation filter chart 700 shows an amplitude-frequency chart and illustrates the desired response 502, the captured playback signal 602, and a compensation filter transfer function 702. In an example, the compensation filter transfer function 702 can represent a transfer function that can be used to process a loudspeaker drive signal such that, when the processed drive signal is reproduced as an acoustic sound by a loudspeaker in a particular environment, then the acoustic sound in the environment or at a particular location in the environment substantially corresponds to the desired response 502. For example, the compensation filter transfer function 702 can represent a transfer function that can be applied to the input signal S_in_playback such that, when the filtered input signal S_in_playback is used to drive the first loudspeaker driver 104 in the playback environment 204, the acoustic sound in the playback environment 204 corresponds to the desired response 502.

In an example, the memory circuit 110 can store information about the compensation filter transfer function 702, or about audio signal processing filters or filter coefficients corresponding to the compensation filter transfer function 702. In an example, the processor circuit 108 can be configured to retrieve the filter parameters or coefficients from the memory circuit 110 and apply them to an arbitrary input signal for the first loudspeaker driver 104. The filtered or processed audio signal can be provided to the first loudspeaker driver 104 and, in response, a filtered acoustic output signal can be provided in the playback environment 204. In an example, the filtered acoustic output signal can correspond to or have the desired response 502 in the playback environment 204. Various methods and techniques for determining or calculating the compensation filter transfer function 702 are further discussed herein in the method examples.

Figure 8:
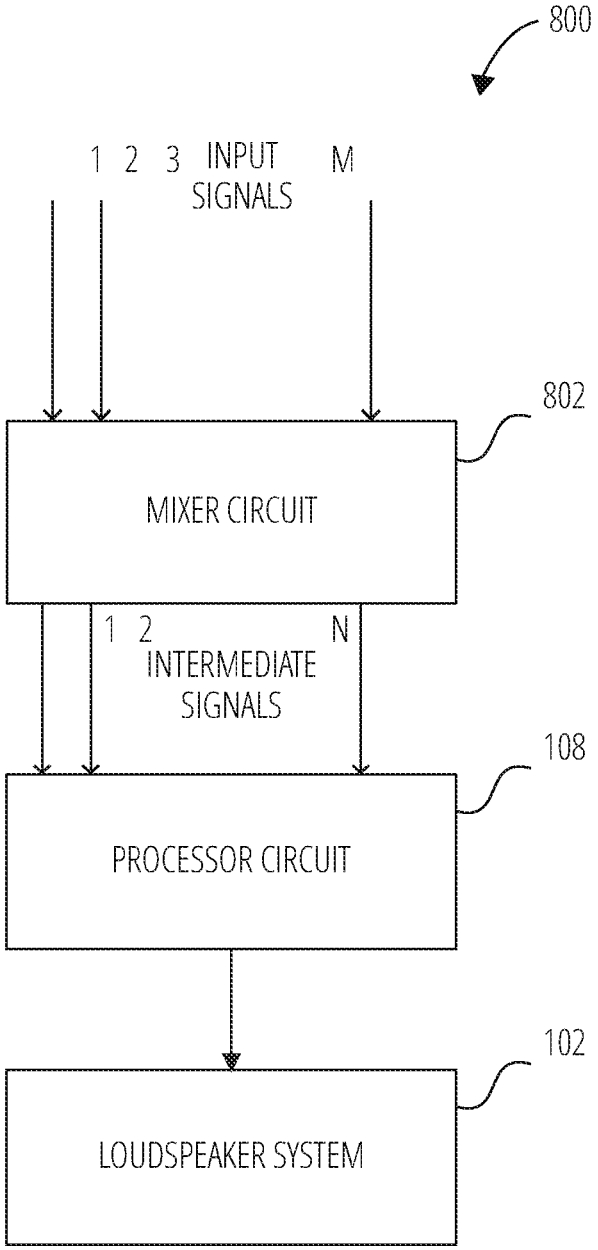
FIG. 8 illustrates generally a system portion that can include a mixer circuit in accordance with an embodiment.

FIG. 8 illustrates generally a system portion 800 that can include a mixer circuit 802 in accordance with an embodiment. In an example, the mixer circuit 802 can be configured to receive multiple audio input signals, such as can include distinct signals or channels of audio information.

In an example, the multiple input signals include or comprise one or more of the input signals S_in, S_in_playback, the drive signal 302, or the input signals can include one or more other signals or channels of audio information or metadata. As shown in the example of FIG. 8, the mixer circuit 802 is configured to receive M distinct signals. The mixer circuit 802 can be configured for upmixing or downmixing and can thereby convert the received M signals into additional or fewer signals.

In an example, the mixer circuit 802 can be used to convert between audio signal formats, such as to convert from a multiple-channel surround sound format comprising, e.g., eight or more distinct channels of information down to, e.g., a stereo pair with two channels of information. Other conversions can similarly be performed using the mixer circuit 802. In an example, the mixer circuit 802 outputs or provides N intermediate signals, and M and N can be unequal.

In an example, the loudspeaker system 102 can receive the N intermediate signals and can use one or more of the N intermediate signals to reproduce sounds in the playback environment 204, such as using one or more loudspeaker drivers. Acoustic information received from the playback environment 204, such as received using the microphone 106, can thus include information from the N intermediate signals as-reproduced in the playback environment 204. In an example, a calculated response for the loudspeaker system 102 can be determined using the N intermediate signals. The calculated response can be used together with information about an actual response, as captured from the playback environment 204, to generate one or more compensation filters. The compensation filters can, in some examples, be signal-specific such that each of the N intermediate signals is differently processed according to a respective filter.

Figure 9:
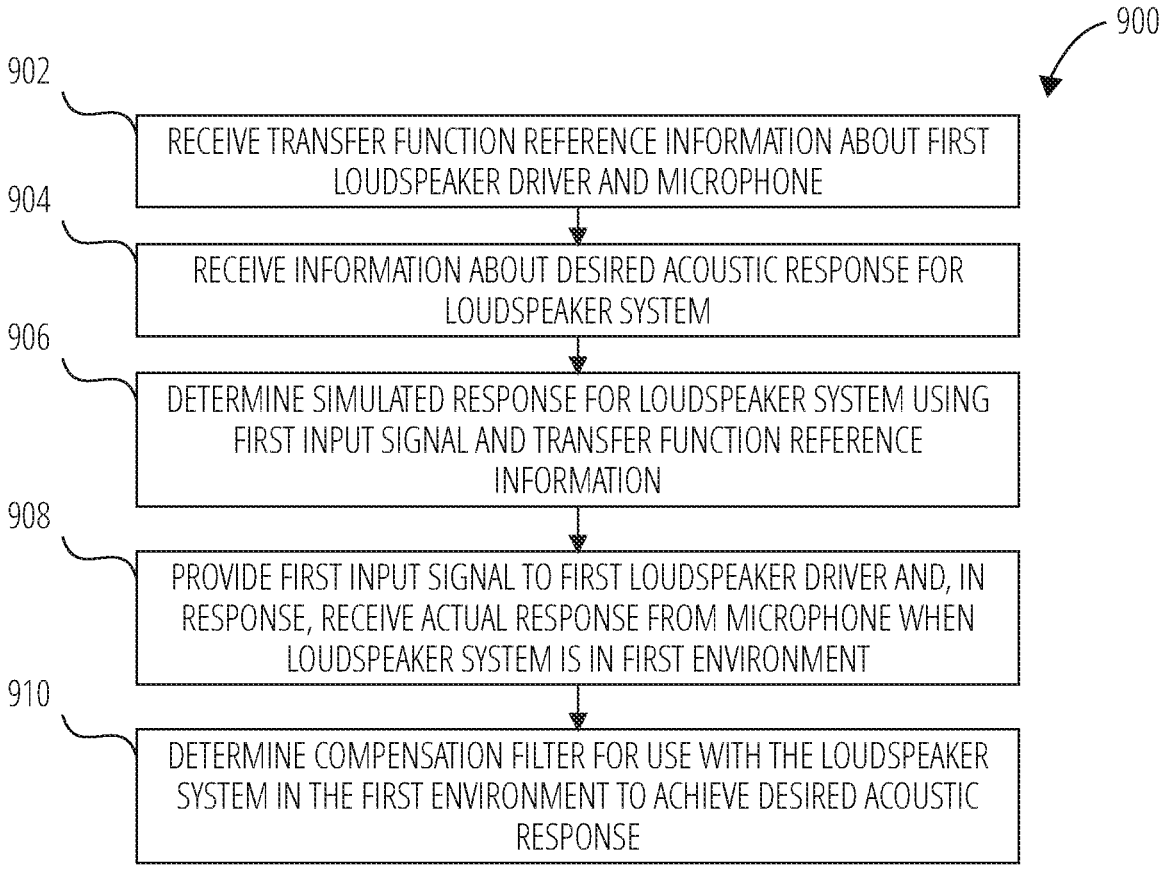
FIG. 9 illustrates generally an example of a first method that can include determining a compensation filter.

FIG. 9 illustrates generally an example of a first method 900 that can include determining a compensation filter. One or more portions of the first method 900 can use the processor circuit 108 or another signal processor.

In block 902, first method 900 can include receiving transfer function reference information about the first loudspeaker driver 104 and the microphone 106. In an example, block 902 can include determining or calculating the transfer function Hspk for the first loudspeaker driver 104 and determining or calculating the transfer function Hm for the microphone 106, such as in the reference environment 112. In an example, determining the transfer functions Hspk or Hm can include using information about the acoustic response signal S_c from the reference environment 112, and using information about the input signal S_in, such that S_c/S_in=Hspk*Hm.

In block 904, the first method 900 can include receiving information about a desired acoustic response for the loudspeaker system. In an example, the desired acoustic response can be specified by a user and can be specific to a particular location or environment. For example, the desired acoustic response can include a user-defined loudspeaker response, such as including a frequency-specific or frequency-band specific augmentation or attenuation of acoustic energy. In an example, the desired acoustic response can include the desired response 502 discussed above.

In block 906, the first method 900 can include determining a simulated response for the loudspeaker system using a first input signal, S_in_playback, and the transfer function reference information. In an example, block 906 can include or use the processor circuit 108 to determine the simulated response. In an example, such as during a playback phase, block 906 can include calculating a response signal S_calc as the simulated response according to S_in_playback Hspk*Hm. The calculated response signal S_calc that represents a simulated response for the loudspeaker system 102 can thus be a function of an arbitrary input signal S_in_playback, the loudspeaker transfer function Hspk, and the microphone transfer function Hm.

In block 908, first method 900 can include providing the first input signal S_in_playback to the first loudspeaker driver 104 and, in response, receiving an actual response from the microphone when the loudspeaker system is in a first environment. The actual response can include, for example, the acoustic response signal S_c_playback received using the microphone 106 when the loudspeaker system 102 is in the playback environment 204.

In block 910, the first method 900 can include determining a compensation filter Hcomp for use with the loudspeaker system 102 in the playback environment 204, such as to achieve or provide a desired acoustic response. In an example, the compensation filter can be determined using the processor circuit 108 to process information about the acoustic response signal S_c_playback and the simulated response signal S_calc. In other words, the compensation filter can be based on a determined simulated response for the loudspeaker system 102 and an actual response for the loudspeaker system 102. The simulated response and the actual response information can be based on the same input signal or stimulus provided to the first loudspeaker driver 104.

Figure 10:
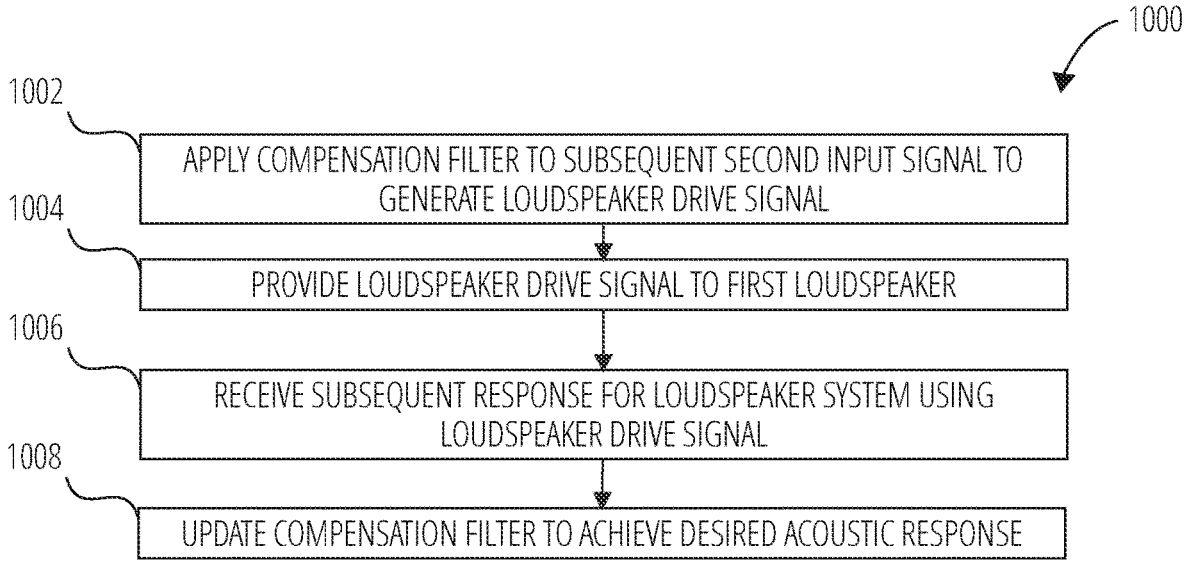
FIG. 10 illustrates generally an example of a second method that can include applying and updating a compensation filter.

FIG. 10 illustrates generally an example of a second method 1000 that can include applying and updating a compensation filter. In an example, the second method 1000 can follow the first method 900, such as after the example of block 910, and can include or use the compensation filter Hcomp. One or more portions of the second method 1000 can use the processor circuit 108 or another signal processor.

In block 1002, the second method 1000 can include applying the compensation filter Hcomp to a subsequent second input signal S_in_subseq to generate a loudspeaker drive signal. In an example, the subsequent second input signal S_in_subseq and the first input signal S_in_playback (see, e.g., block 906) can comprise portions of the same audio program, or can include signals or information from different programs or different sources. In an example, the first and subsequent second input signals comprise time-adjacent portions of a substantially continuous signal. In block 1004, the second method 1000 can include providing the loudspeaker drive signal to the first loudspeaker driver 104. That is, block 1004 can include providing a drive signal to the first loudspeaker driver 104 that includes the subsequent second input signal S_in_subseq as processed or filtered according to the compensation filter Hcomp.

In block 1006, the second method 1000 can include receiving a subsequent response signal S_c_subseq for the loudspeaker system such as in response to the loudspeaker drive signal provided at block 1004. The subsequent response signal received in block 1006 can include a signal that can be received or captured at an input of the microphone 106. The subsequent response signal S_c_subseq can be represented as a function of the subsequent second input signal S_in_subseq processed according to the transfer function Hspk of the first loudspeaker driver 104, the transfer function Hm of the microphone 106, and the room effect transfer function Hr_playback, that is, S_c_subseq=S_in_subseq*Hspk*Hm*Hr_playback.

In block 1008, the second method 1000 can include updating the compensation filter Hcomp to achieve the desired acoustic response. The updated compensation filter can be based on, for example, the received subsequent response signal S_c_subseq, for example, according to the example of the first method 900. The compensation filter Hcomp can be updated periodically or, in an example, in response to a user input or other indication that recalibration or adjustment of the loudspeaker system 102 is desired. In an example, updating the compensation filter at block 1008 can include, for example, adjusting a value of an equalization filter, or changing filter coefficients or otherwise modifying or adjusting the filter.

Figure 11:
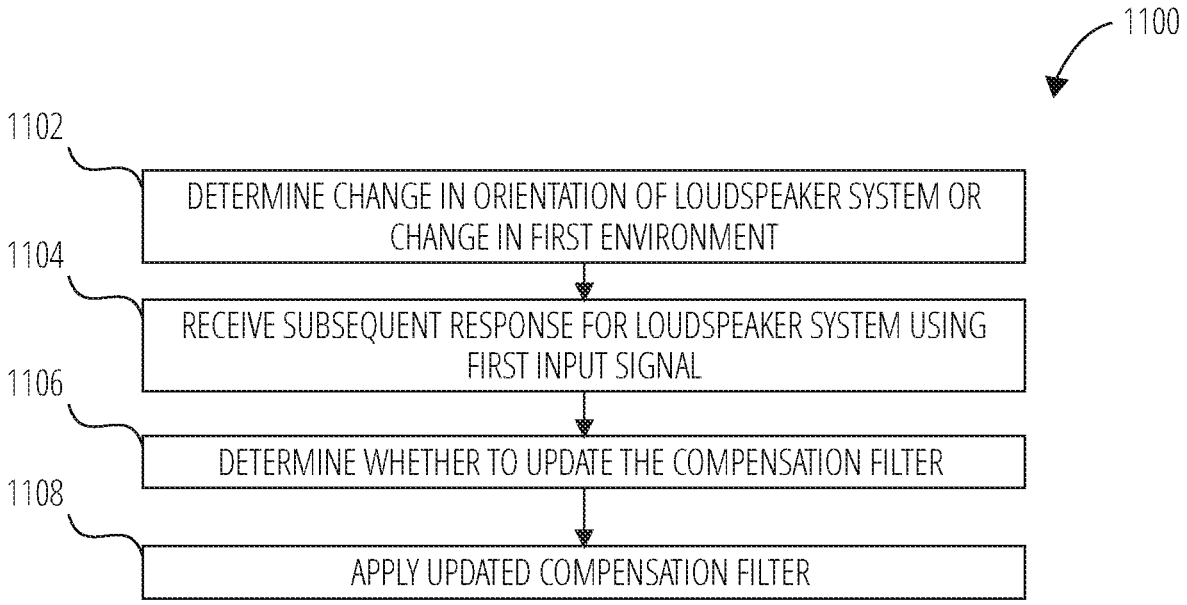
FIG. 11 illustrates generally an example of a third method that can include determining a change in a loudspeaker system.

FIG. 11 illustrates generally an example of a third method 1100 that can include determining a change in the loudspeaker system 102. In an example, the third method 1100 can follow the first method 900, such as after the example of block 910, or can following the second method 1000, and can include or use the compensation filter Hcomp. One or more portions of the third method 1100 can use the processor circuit 108 or another signal processor.

In block 1102, the third method 1100 can include determining a change in an orientation of the loudspeaker system 102 or a change in an environment. In an example, block 1102 can include or use information from the sensor 114 to determine whether the loudspeaker system 102 moved and therefore changed its position relative to an environment, such as the playback environment 204, or to determine when or whether the loudspeaker system 102 is relocated to a different environment. In an example, the information from the sensor 114 can include information from an accelerometer or information from another position or location sensor.

In an example, block 1102 can include determining whether a magnitude or amount of the change in orientation or position of the loudspeaker system 102 meets or exceeds a specified threshold system movement or threshold system orientation change amount. For example, if a detected rotation or angle of the loudspeaker system 102 changes by greater than a specified threshold rotation limit, then the third method 1100 can proceed according to subsequent steps in the third method 1100. If, however, the detected rotation or angle of the loudspeaker system 102 does not change by a sufficient amount, then the third method 1100 can terminate and a previously established compensation filter, such as Hcomp, can remain in effect. Similarly, if a location of the loudspeaker system 102 changes by greater than a specified threshold distance, such as can be determined using information from the sensor 114, then the third method 1100 can proceed.

In an example, other conditions under which the third method 1100 can advance beyond block 1102 can be established. For example, information about the change in orientation can be provided by a user or the loudspeaker system 102 can be configured to periodically perform the third method 1100 as part of a routine or scheduled system performance update.

In block 1104, the third method 1100 can include receiving information about a subsequent response for the loudspeaker system 102, for example using the same first input signal discussed in the example of FIG. 9. That is, block 1104 can include using the same first input signal S_in_playback and, in response, capturing response information or signals using the microphone 106. In an example, the subsequent response information can be used together with reference information to generate a prospective compensation filter Hcomp_pro.

In block 1106, the third method 1100 can include determining whether to update a previously established compensation filter, for example, Hcomp. In an example, the previously established compensation filter Hcomp can be compared to the prospective compensation filter Hcomp_pro. If the prospective compensation filter Hcomp_pro differs from the previously established filter such as by greater than a specified threshold difference amount, such as in one or more frequency bands, then the third method 1100 can continue to block 1108.

At block 1108, a compensation filter in use or for use with the loudspeaker system 102 can be updated to include or use the prospective compensation filter Hcomp_pro. In an example, the prospective compensation filter Hcomp_pro can represent a filter for less than all of an acoustic spectrum. For example, Hcomp_pro can represent a filter that applies over a relatively narrow band of frequencies, or can represent a filter for low frequency information or high frequency information or for another designated band of acoustic information. In an example, a portion of a compensation filter in use or for use with the loudspeaker system 102, such as Hcomp, can be updated using information from the prospective compensation filter Hcomp_pro. That is, a previously established compensation filter Hcomp can be updated in whole or in part using information from the prospective compensation filter Hcomp_pro.

Figure 12:
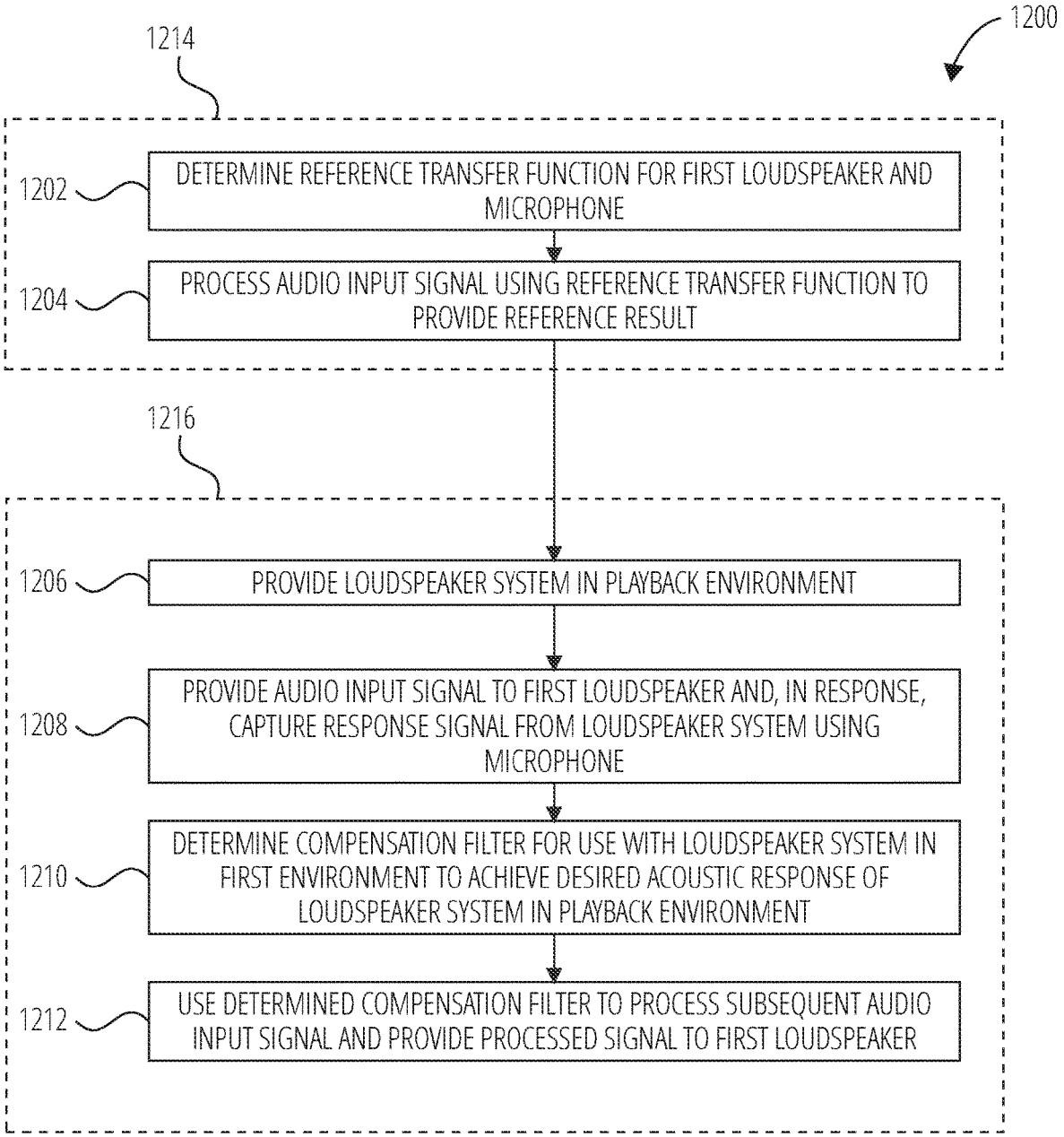
FIG. 12 illustrates generally an example of a fourth method that can include determining a compensation filter for use with a loudspeaker system to achieve a desired response in a playback environment.

FIG. 12 illustrates generally an example of a fourth method 1200 that can include determining a compensation filter for use with the loudspeaker system 102 to achieve a desired response in a playback environment. In an example, one or more portions of the fourth method 1200 can use the processor circuit 108 or another signal processor.

The example of the fourth method 1200 can include a design phase 1214 and a playback phase 1216. In the design phase 1214, the fourth method 1200 can include at least block 1202 and can optionally further include block 1204. In block 1202, the fourth method 1200 can include determining a reference transfer function for the first loudspeaker driver 104 and for the microphone 106 of the loudspeaker system 102. In an example, block 1202 can include using the loudspeaker system 102 in the reference environment 112 with a reference input signal to obtain information about one or both of the transfer function Hspk of the first loudspeaker driver 104 and the transfer function Hm of the microphone 106.

In block 1204, the fourth method 1200 can include processing an audio input signal using the reference transfer function to provide a reference result. In an example, the audio input signal in block 1204 can include a portion of an audio program and can include a partial spectrum signal or full spectrum signal. In an example, the audio input signal processed in block 1204 can include the input signal S_in_playback and the reference result can be a function of the input signal S_in_playback and of the transfer functions Hspk and Hm of the first loudspeaker driver 104 and the microphone 106 respectively.

In an example, block 1206 through block 1212 can comprise portions of the playback phase 1216. In block 1206, the fourth method 1200 can include providing the loudspeaker system 102 in the playback environment 204. In block 1208, the fourth method 1200 can include providing the audio input signal S_in_playback to the first loudspeaker and, in response, capturing a response signal S_c_playback from the loudspeaker system 102 using the microphone 106.

In block 1210, the fourth method 1200 can include determining a compensation filter Hcomp for use with the loudspeaker system 102 in the playback environment 204 to achieve a desired acoustic response of the loudspeaker system 102 in the playback environment 204. In an example, the compensation filter Hcomp can be calculated or determined based on the reference result provided at block 1204 and based on the captured response signal S_c_playback from the loudspeaker system 102 in the playback environment 204.

In block 1212, the fourth method 1200 can include using the compensation filter Hcomp to process a subsequent audio input signal to generate a processed signal, and providing the processed signal to the first loudspeaker driver 104. In an example, the subsequent audio input signal comprises a portion of the same audio program as the input signal S_in_playback. That is, the input signal S_in_playback and the subsequent audio input signal can be different portions of a continuous audio signal.

Figure 13:
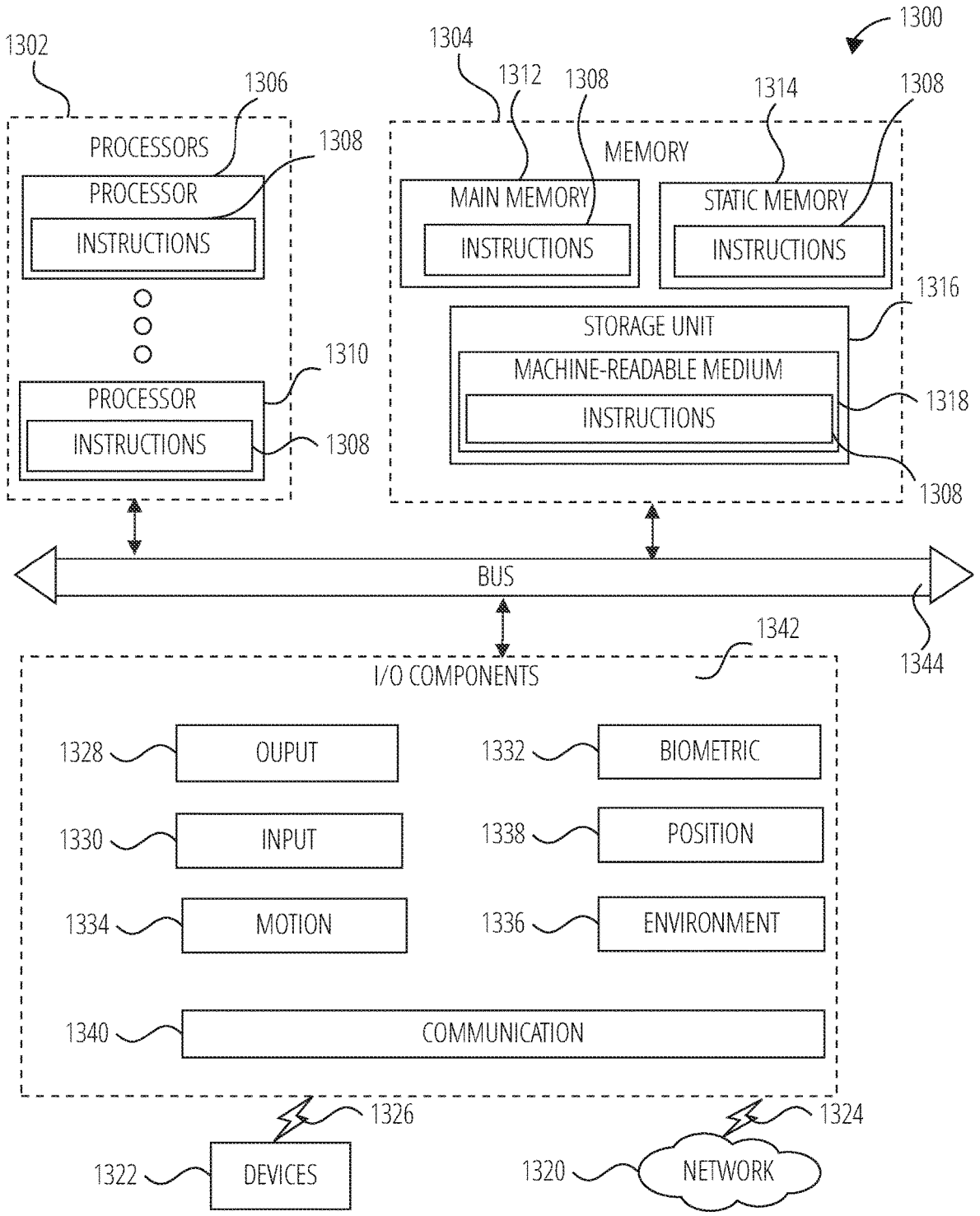
FIG. 13 illustrates generally a diagram of a machine in the form of a computer system within which a set of instructions may be executed for causing the machine to perform any one or more of the methods discussed herein.

FIG. 13 is a diagrammatic representation of a machine 1300 within which instructions 1308 (e.g., software, a program, an application, an applet, an app, or other executable code) for causing the machine 1300 to perform any one or more of the methodologies discussed herein can be executed. For example, the instructions 1308 can cause the machine 1300 to execute any one or more of the methods described herein. The instructions 1308 can transform the general, non-programmed machine 1300 into a particular machine 1300 programmed to carry out the described and illustrated functions in the manner described.

In an example, the machine 1300 can operate as a standalone device or can be coupled (e.g., networked) to other machines or devices or processors. In a networked deployment, the machine 1300 can operate in the capacity of a server machine or a client machine in a server-client network environment, or as a peer machine in a peer-to-peer (or distributed) network environment. The machine 1300 can comprise a server computer, a client computer, a personal computer (PC), a tablet computer, a laptop computer, a netbook, a set-top box (STB), a PDA, an entertainment media system, a cellular telephone, a smart phone, a mobile device, a wearable device (e.g., a smart watch), a smart home device (e.g., a smart appliance), other smart devices, a web appliance, a network router, a network switch, a network bridge, or any machine capable of executing the instructions 1308, sequentially or otherwise, that specify actions to be taken by the machine 1300. Further, while only a single machine 1300 is illustrated, the term "machine" can be taken to include a collection of machines that individually or jointly execute the instructions 1308 to perform any one or more of the methodologies discussed herein. In an example, the instructions 1308 can include instructions stored using the memory circuit 110, and the machine 1300 can include or use the processor circuit 108 from the example of the loudspeaker system 102.

The machine 1300 can include various processors and processor circuitry, such as represented in the example of FIG. 13 as processors 1302, memory 1304, and I/O components 1342, which can be configured to communicate with each other via a bus 1344. In an example, the processors 1302 (e.g., a Central Processing Unit (CPU), a Reduced Instruction Set Computing (RISC) processor, a Complex Instruction Set Computing (CISC) processor, a Graphics Processing Unit (GPU), a Digital Signal Processor (DSP), an ASIC, a Radio-Frequency integrated Circuit (RFIC), another processor, or any suitable combination thereof) can include, for example, a processor 1306 and a processor 1310 that execute the instructions 1308. The term "processor" is intended to include multi-core processors that can comprise two or more independent processors (sometimes referred to as "cores") that can execute instructions contemporaneously. Although FIG. 13 shows multiple processors, the machine 1300 can include a single processor with a single core, a single processor with multiple cores (e.g., a multi-core processor), multiple processors with a single core, multiple processors with multiples cores, or any combination thereof, for example to provide the processor circuit 108.

The memory 1304 can include a main memory 1312, a static memory 1314, or a storage unit 1316, such as can be accessible to the processors 1302 via the bus 1344. The memory 1304, the static memory 1314, and storage unit 1316 can store the instructions 1308 embodying any one or more of the methods or functions or processes described herein. The instructions 1308 can also reside, completely or partially, within the main memory 1312, within the static memory 1314, within the machine-readable medium 1318 within the storage unit 1316, within at least one of the processors (e.g., within a processor's cache memory), or any suitable combination thereof, during execution thereof by the machine 1300.

The I/O components 1342 can include a wide variety of components to receive input, provide output, produce output, transmit information, exchange information, capture measurements, and so on. The specific I/O components 1342 that are included in a particular machine will depend on the type of machine. For example, portable machines such as mobile phones can include a touch input device or other such input mechanisms, while a headless server machine will likely not include such a touch input device. It will be appreciated that the I/O components 1342 can include many other components that are not shown in FIG. 13. In various example embodiments, the I/O components 1342 can include output components 1328 and input components 1330. The output components 1328 can include visual components (e.g., a display such as a plasma display panel (PDP), a light emitting diode (LED) display, a liquid crystal display (LCD), a projector, or a cathode ray tube (CRT)), acoustic components (e.g., speakers), haptic components (e.g., a vibratory motor, resistance mechanisms), other signal generators, and so forth. The input components 1330 can include alphanumeric input components (e.g., a keyboard, a touch screen configured to receive alphanumeric input, a photo-optical keyboard, or other alphanumeric input components), point-based input components (e.g., a mouse, a touchpad, a trackball, a joystick, a motion sensor, or another pointing instrument), tactile input components (e.g., a physical button, a touch screen that provides location and/or force of touches or touch gestures, or other tactile input components), audio input components (e.g., a microphone), and the like.

In an example, the I/O components 1342 can include biometric components 1332, motion components 1334, environmental components 1336, or position components 1338, among a wide array of other components. For example, the biometric components 1332 include components configured to detect a presence or absence of humans, pets, or other individuals or objects, or configured to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram-based identification), and the like. The motion components 1334 can include acceleration sensor components (e.g., accelerometer), gravitation sensor components, rotation sensor components (e.g., gyroscope), and so forth, and can comprise the sensor 114.

The environmental components 1336 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect background noise), proximity sensor components (e.g., infrared sensors that detect nearby objects), gas sensors (e.g., gas detection sensors to detection concentrations of hazardous gases for safety or to measure pollutants in the atmosphere), or other components that can provide indications, measurements, or signals corresponding to a surrounding physical environment. The position components 1338 include location sensor components (e.g., a GPS receiver component, an RFID tag, etc.), altitude sensor components (e.g., altimeters or barometers that detect air pressure from which altitude can be derived), orientation sensor components (e.g., magnetometers), and the like.

The I/O components 1342 can include communication components 1340 operable to couple the machine 1300 to a network 1320 or devices 1322 via a coupling 1324 and a coupling 1326, respectively. For example, the communication components 1340 can include a network interface component or another suitable device to interface with the network 1320. In further examples, the communication components 1340 can include wired communication components, wireless communication components, cellular communication components, Near Field. Communication (NFC) components, Bluetooth® components (e.g., Bluetooth® Low Energy), WiFi® components, and other communication components to provide communication via other modalities. The devices 1322 can be another machine or any of a wide variety of peripheral devices (e.g., a peripheral device coupled via a USB).

Moreover, the communication components 1340 can detect identifiers or include components operable to detect identifiers. For example, the communication components 1340 can include Radio Frequency Identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF417, Ultra Code, UCC RSS-2D bar code, and other optical codes), or acoustic detection components (e.g., microphones to identify tagged audio signals). In addition, a variety of information can be derived via the communication components 1340, such as location via Internet Protocol (IP) geolocation, location via Wi-Fi® signal triangulation, or location via detecting an NFC beacon signal that can indicate a particular location, and so forth.

The various memories (e.g., memory 1304, main memory 1312, static memory 1314, and/or memory of the processors 1302) and/or storage unit 1316 can store one or more instructions or data structures (e.g., software) embodying or used by any one or more of the methodologies or functions described herein. These instructions (e.g., the instructions 1308), when executed by processors or processor circuitry, cause various operations to implement the embodiments discussed herein.

The instructions 1308 can be transmitted or received over the network 1320, using a transmission medium, via a network interface device (e.g., a network interface component included in the communication components 1340) and using any one of a number of well-known transfer protocols (e.g., hypertext transfer protocol (HTTP)). Similarly, the instructions 1308 can be transmitted or received using a transmission medium via the coupling 1326 (e.g., a peer-to-peer coupling) to the devices 1322.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein."

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made. As will be recognized, certain embodiments of the inventions described herein can be embodied within a form that does not provide all of the features and benefits set forth herein, as some features can be used or practiced separately from others.

Moreover, although the subject matter has been described in language specific to structural features or methods or acts, it is to be understood that the subject matter defined in the appended claims is not necessarily limited to the specific features or acts described above. Rather, the specific features and acts described above are disclosed as example forms of implementing the claims.

What is claimed is:

1. A method for equalizing an acoustic response for a loudspeaker system, the loudspeaker system including a first loudspeaker driver provided in a substantially fixed spatial relationship relative to a microphone, the method comprising:

receiving transfer function reference information about the first loudspeaker driver and the microphone;

receiving information about a desired acoustic response for the loudspeaker system;

determining a simulated response for the loudspeaker system using a first input signal and the transfer function reference information;

providing the first input signal to the first loudspeaker driver and, in response, receiving an actual response from the microphone when the loudspeaker system is in a first environment; and determining a compensation filter for use with the loudspeaker system in the first environment to achieve the desired acoustic response, wherein the compensation filter is based on the determined simulated response and the received actual response for the loudspeaker system.

2. The method of claim 1, wherein the first input signal comprises a test signal including one or more of a sine wave sweep signal, an impulse signal, and a noise signal.

3. The method of claim 1, wherein the first input signal comprises an audio signal with user-specified acoustic program information.

4. The method of claim 1, wherein the first input signal comprises a multiple-channel or multiple-band audio signal;

wherein determining the simulated response includes using a down-mixed version of the audio signal; and wherein providing the first input signal to the first loudspeaker driver includes providing the down-mixed version of the audio signal.

5. The method of claim 1, further comprising:

applying the compensation filter to a subsequent second input signal to provide a loudspeaker drive signal; and providing the loudspeaker drive signal to the first loudspeaker;

wherein the first input signal and the subsequent second input signal comprise different portions of an audio program.

6. The method of claim 5, further comprising:

receiving a subsequent response for the loudspeaker system using the loudspeaker drive signal; and updating the compensation filter to achieve the desired acoustic response, wherein the updated compensation filter is based on the received subsequent response for the loudspeaker system.

7. The method of claim 1, wherein receiving the transfer function reference information includes receiving information about the first loudspeaker driver, the microphone, and a loudspeaker equalizer filter, and wherein receiving the information about the desired acoustic response for the loudspeaker system includes receiving a user input indicating a preferred equalization for the loudspeaker system.

8. The method of claim 1, wherein determining the simulated response for the loudspeaker system includes using at least one audio signal filter, the audio signal filter configured to provide one or more of spatial enhancement, virtualization, equalization, loudness control, dialog enhancement, compression, or limiting; and wherein providing the first input signal includes providing the first input signal as-processed using the audio signal filter.

9. The method of claim 1, wherein determining the compensation filter includes determining at least a low frequency compensation filter to correct for room effects of the first environment.

10. The method of claim 1, further comprising:

determining a change in an orientation of the loudspeaker system or a change in the first environment and, in response:

receiving a subsequent response for the loudspeaker system using the first input signal; and updating the compensation filter based on the determined simulated response and the received subsequent response for the loudspeaker system.

11. The method of claim 10, wherein determining the change in the orientation of the loudspeaker or the change in the first environment includes using information from an accelerometer coupled to the loudspeaker system.

12. The method of claim 1, wherein receiving the transfer function reference information includes determining, for the loudspeaker system in a reference environment, a loudspeaker transfer function and a microphone transfer function.

13. A method of equalizing an acoustic response for a loudspeaker system, the loudspeaker system including a first loudspeaker and at least one built-in microphone, the method comprising:

in a design phase:

determining a reference transfer function for the first loudspeaker and the microphone; and processing an audio input signal using the reference transfer function to provide a reference result;

in a playback phase, wherein the loudspeaker system is provided in a first environment:

providing the audio input signal to the first loudspeaker and, in response, capturing a response signal from the loudspeaker system using the microphone; and determining a compensation filter for use with the loudspeaker system in the first environment to achieve a desired acoustic response of the loudspeaker system in the first environment, wherein the compensation filter is based on the reference result and the captured response signal from the loudspeaker system.

14. The method of claim 13, further comprising, in the playback phase, using the compensation filter as-determined to process a subsequent audio input signal and providing the processed signal to the first loudspeaker.

15. The method of claim 13, further comprising determining a change in an orientation of the loudspeaker system or a change in the first environment and, in response, determining an updated compensation filter for use with the loudspeaker system.

16. An adaptive loudspeaker equalizer and loudspeaker system, the system comprising:

a processor circuit; and a memory storing instructions that, when executed by the processor circuit, configure the system to determine a compensation filter to apply to an input signal for at least one loudspeaker driver in the system to achieve a desired acoustic response for the system, wherein the compensation filter is based on (1) transfer function reference information about the at least one loudspeaker driver and about a microphone, (2) a simulated response of the at least one loudspeaker driver to a first input signal, and (3) output information, received using the microphone, from the at least one loudspeaker driver when the driver receives a stimulus comprising the first input signal.

17. The system of claim 16, further comprising the at least one loudspeaker driver; and the microphone;

wherein the at least one loudspeaker driver the microphone are physically coupled in a substantially fixed spatial relationship.

18. The system of claim 16, wherein the memory includes further instructions that, when executed by the processor circuit, configure the system to receive a subsequent input signal, process the subsequent input signal using the compensation filter to generate a processed signal, and provide the processed signal to the at least one loudspeaker driver.

19. The system of claim 16, further comprising a sensor configured to provide sensor information to the processor circuit about a change in a location or orientation of the system;

wherein the memory includes further instructions that, when executed by the processor circuit, configure the system to update the compensation filter in response to the sensor information.

20. The system of claim 16, wherein the memory includes further instructions that, when executed by the processor circuit, configure the system to determine the transfer function reference information about the at least one loudspeaker driver and about the microphone.

* * * * *